US011359348B1

(12) United States Patent
Balderas

(10) Patent No.: US 11,359,348 B1
(45) Date of Patent: Jun. 14, 2022

(54) EXCAVATION BUCKET WITH A CHAIN ADHERENT RELEASE DEVICE

(71) Applicant: Grace Abundantly, LLC, Eureka, MO (US)

(72) Inventor: Michael Justin Balderas, Eureka, MO (US)

(73) Assignee: Grace Abundantly LLC, Eureka, MO (US)

( * ) Notice: Subject to any disclaimer, the term of this patent is extended or adjusted under 35 U.S.C. 154(b) by 0 days.

(21) Appl. No.: 17/520,283

(22) Filed: Nov. 5, 2021

Related U.S. Application Data

(63) Continuation-in-part of application No. 17/162,961, filed on Jan. 29, 2021, now abandoned.

(51) Int. Cl.
*E02F 3/407* (2006.01)

(52) U.S. Cl.
CPC ..... *E02F 3/407* (2013.01)

(58) Field of Classification Search
CPC ..... Y10S 37/901
See application file for complete search history.

(56) References Cited

U.S. PATENT DOCUMENTS 990,232 A * 4/1911 Cross ..... E02F 3/40 37/444
2,501,489 A * 3/1950 Aisthorpe ..... E02F 3/60 37/189
3,035,724 A 5/1962 Clark
3,349,934 A 10/1967 Moyer
3,630,396 A * 12/1971 Womack ..... E02F 3/407 37/901
5,241,764 A * 9/1993 Modig ..... E02F 7/06 37/405
5,315,772 A 5/1994 Lalonde
(Continued)

FOREIGN PATENT DOCUMENTS

CN 212026383 U 4/2020
DE 78234 11/1894
(Continued)

OTHER PUBLICATIONS

Attempt to Remove Clay From Backhoe Bucket. SolarDrew. YouTube. Apr. 13, 2017. Retrieved Jan. 26, 2022. (Year: 2017).*
https://www.youtube.com/watch?v=Pghb-2NX5Gc Youtube video.

*Primary Examiner* — Jessica H Lutz
(74) *Attorney, Agent, or Firm* — Linda L. Lewis

(57) ABSTRACT

An excavation bucket with a chain adherent release device, wherein inside the bucket is two side chains positioned proximate the bucket sides, at least one inner chain spaced between the side chains, and at least one cross chain attached to the side chains and positioned between the front and back of the bucket and attached to the at least one inner chain, but not attached to the bottom of the bucket. The side chains, the at least one inner chain and the at least one cross chain form a grid. The side chains and at least one of the inner chain each have both back attachment points proximate the back of the bucket and front attachment points proximate the front of the bucket. The grid has sufficient length to lie untensioned on the bottom of the bucket when it is in the empty and upright position and has direct, uninterrupted and continuous contact with the bottom of the bucket.

18 Claims, 7 Drawing Sheets

(56) References Cited

U.S. PATENT DOCUMENTS

| | | | | |
|---|---|---|---|---|
| 5,515,624 | A * | 5/1996 | Beatty | E02F 3/60 37/316 |
| 5,680,717 | A | 10/1997 | Bierwith | |
| 7,624,522 | B1 * | 12/2009 | Ammons | E02F 3/4075 37/444 |
| 8,893,409 | B1 * | 11/2014 | Rossi, Jr. | E02F 3/407 209/660 |
| 9,611,623 | B2 * | 4/2017 | Sager | E02F 3/407 |
| 2005/0193598 | A1 * | 9/2005 | Buhse | E02F 3/60 37/398 |
| 2005/0264018 | A1 * | 12/2005 | Cummings | E02F 3/404 294/197 |
| 2007/0144043 | A1 | 6/2007 | Semke | |

FOREIGN PATENT DOCUMENTS

| | | | | |
|---|---|---|---|---|
| JP | 09296476 | A * | 11/1997 | E02F 3/407 |
| JP | 11256610 | A * | 9/1999 | |
| JP | 2000212988 | A * | 8/2000 | |

* cited by examiner

EXCAVATION BUCKET WITH A CHAIN ADHERENT RELEASE DEVICE

CROSS-REFERENCE TO RELATED APPLICATIONS

This application is a continuation-in-part filing of the utility patent application Ser. No. 17/162,961 filed Jan. 29, 2021, which is hereby incorporated by reference.

STATEMENT REGARDING FEDERALLY SPONSORED RESEARCH

Not Applicable.

APPENDIX

Not Applicable.

BACKGROUND OF THE INVENTION

Field of the Invention

The present invention relates to excavation device buckets, and more particularly to a chain grid for an excavation bucket which effectively removes excavated materials adhering to the bottom of the bucket.

Related Art

Excavation equipment, such as a Skid Steer, wheel loader, tractor, or backhoe uses a bucket, and is used to dig and move the materials to a desired location. The materials excavated may comprise soil, mud, clay, rocks, broken concrete, asphalt or other materials. When excavating sticky soil, mud or clay, the material can adhere to the inside wall of the bucket, reducing the capacity of the bucket, and decreasing the working efficiency of the excavator.

Cleaning the bucket of adherent typically involves the lengthy process of stopping work, shutting down the excavation machine, and prying out the adhering sticky materials. Well known methods of preventing the sticking of materials includes the use of oils on the bucket or plastic liners, and the drilling of holes in the bottom of the bucket. These methods have very limited effectiveness.

The use of a chain or chains attached to the inside of the bucket to remove adherents has been disclosed. It has been disclosed that chains can be in an "H" or an "X" configuration, where the chains are attached at the endpoints and the remainder of the chain is loose and lies along the bottom of the bucket. A single chain and two chains have been disclosed. Heavy one inch chains have been disclosed.

Yoshida patent JP 2000212988 discloses a chain device to remove adherents from an excavator bucket. Yoshida's device uses a leaf spring attached between the chain and the bucket to move the chain away from the bucket as the bucket is dumped. Yoshida's device is easily clogged with debris that wedges under the leaf spring, causing it to stay in the upward, untensioned position. This causes it to fail to remove adherents from the bottom of the bucket. Applicant's invention is designed to not have any device between the chain and the bucket to remove adherents from the bottom of the bucket. Applicant's invention provides a chain grid that has direct, continuous and uninterrupted contact with the bottom of the bucket when the bucket is in the empty and upright position. The debris that is collected falls on top of the grid and is removed when the bucket is emptied and the grid falls outward, away from the bottom of the bucket.

Chinese patent CN212026383 discloses a pendant device inside the bucket to dislodge clay or other materials. The pendant uses a chain or wire attached at the back inside of the bucket, and a weight attached at the free end of the chain. In one embodiment there are three pendants with three spaced cross wires attached to the pendants. When the bucket is emptied, the pendant swings to help empty the bucket.

None of the above references disclose the claimed invention as described.

SUMMARY OF THE INVENTION

The present invention is an excavation bucket with a chain adherent release device, wherein the bucket has a bottom and two sides, an inside configured to hold materials, a front, a back and, optionally, a set of teeth. Attached inside the bucket is a chain grid, wherein the chain grid has two side chains positioned proximate the bucket sides, at least one inner chain spaced between the side chains, and at least one cross chain attached to the side chains and positioned between the front and back of the bucket and, optionally, attached to the at least one inner chain, but not attached to the bottom of the bucket. The side chains and the at least one inner chain each have both back attachment points proximate the back of the bucket and front attachment points proximate the front of the bucket. The back attachment points and the front attachment points are spaced across the back of the bucket and the front of the bucket, respectively. The at least one inner chain, the side chains and the at least one cross chain have a sufficient length to have contact with the bottom of the bucket, and to lie untensioned in the bottom of the bucket when the bucket is in the empty and upright position. The chain grid has direct, continuous and uninterrupted contact with the bottom of the bucket when the bucket is in the empty and upright position.

Optionally, the excavation bucket with a chain adherent release device also includes at least one pull chain having one end attached to the side chain, the inner chain, or the cross chain between the front of the bucket and the back of the bucket, and the second end attached outside the bucket. The pull chain has sufficient length to allow the chain grid to lie untensioned in the bottom of the when the bucket is in the empty and upright position, and is proximate the sides of the bucket.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
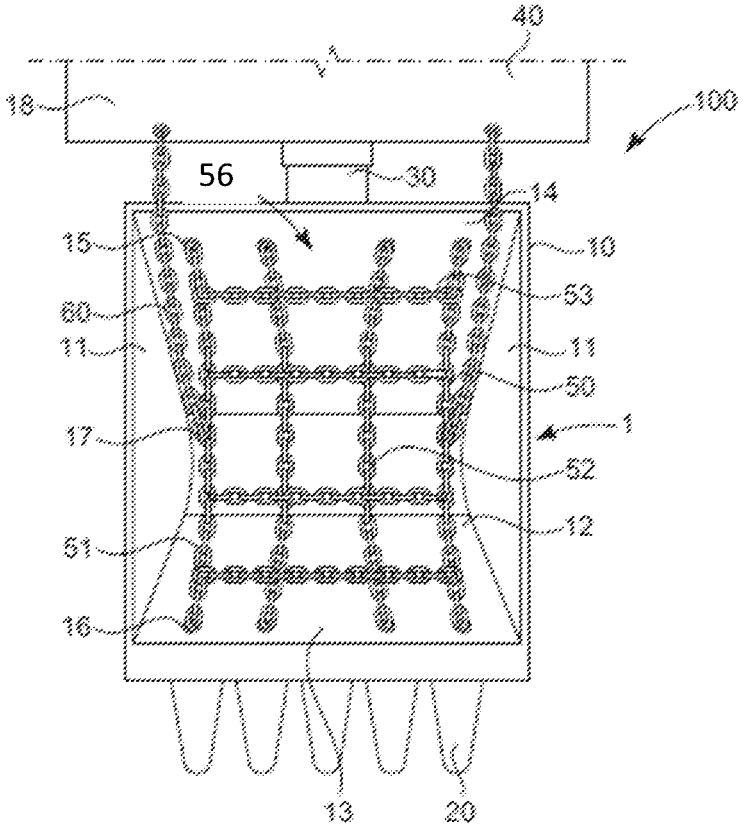
FIG. 1 is a top view of an embodiment of the present invention in the empty and upright position.
Figure 2:
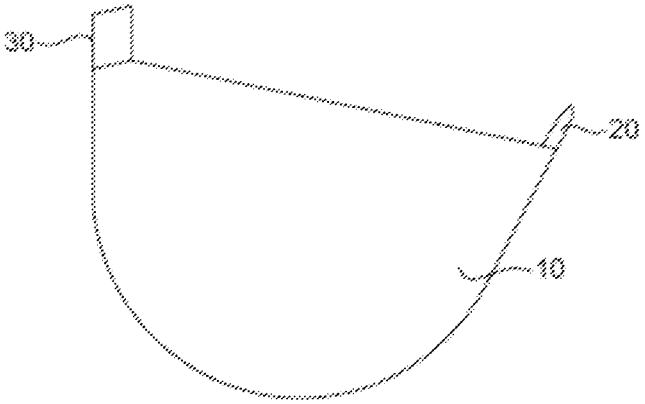
FIG. 2 is a side view of an embodiment of the present invention in the upright position.
Figure 1A:
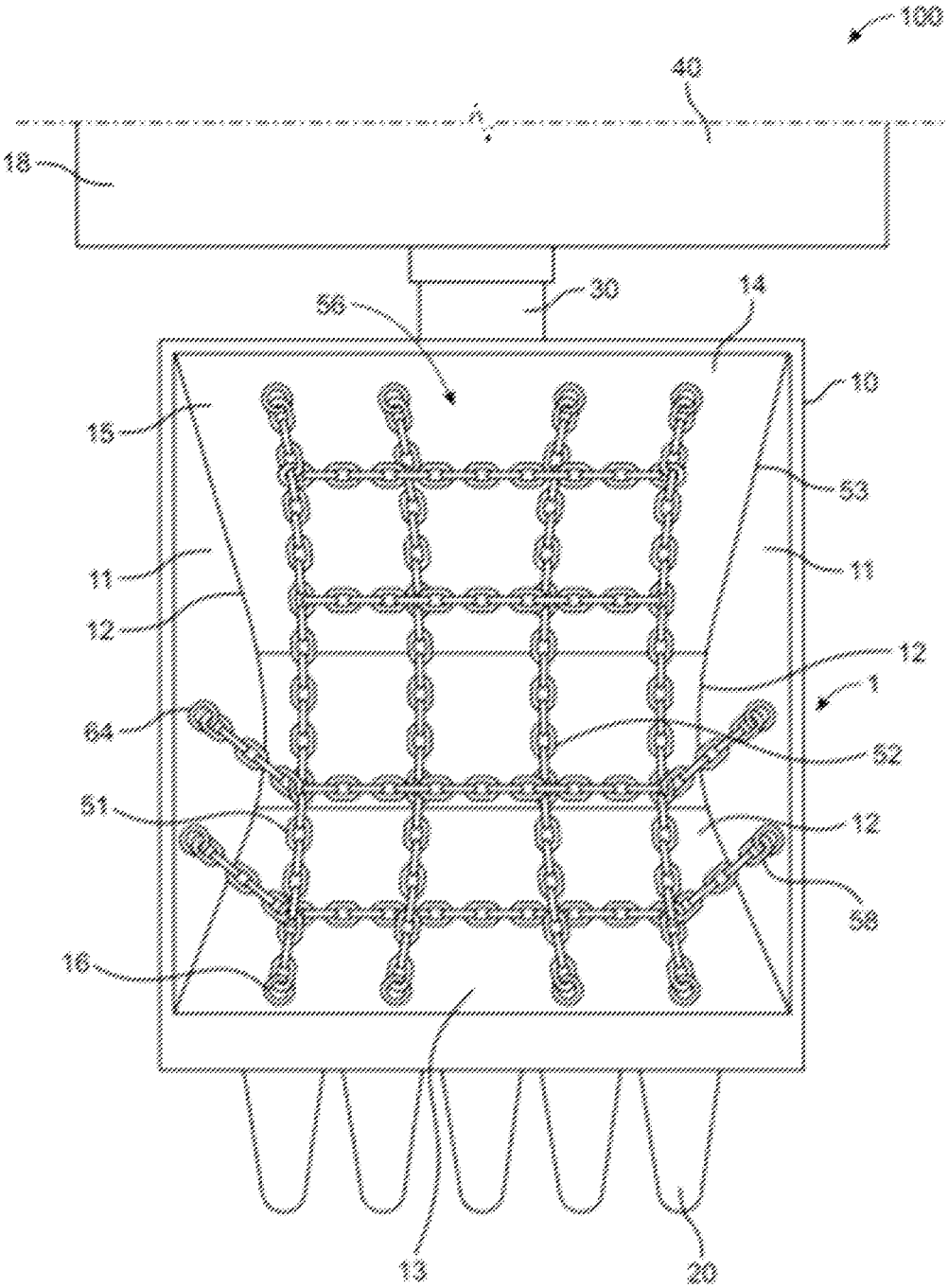

The following description of the preferred embodiment(s) is merely exemplary in nature and is in no way intended to limit the invention, its application, or uses.

As shown in FIGS. 1, 9, 2 and 3, the present invention is an excavation bucket with a chain adherent release device 100, wherein the bucket 10 has a bottom 12 and two sides 11, an inside 1 configured to hold materials, a front 13, a back 14 and, optionally, a set of teeth 20. The teeth are attached to the front of the bucket. Attached to the back of the bucket is an arm 30. Attached inside the bucket is a chain grid 56, wherein the chain grid has two side chains 51 positioned proximate the bucket sides 11, at least one inner chain 52 spaced between the side chains, and at least one cross chain 53 attached to the side chains and positioned between the front 13 and back 14 of the bucket and, optionally, attached to the at least one inner chain, but not attached to the bottom 12 of the bucket. Preferably, the side chains, the at least one inner chain and the at least one cross chain are attached at each intersection of the chains. The preferred method of attachment is welding. The side chains and at least one of the inner chain each have both back attachment points 15 proximate the back of the bucket and front attachment points 16 proximate the front of the bucket. The back attachment points and the front attachment points are spaced across the back of the bucket and the front of the bucket, respectively. The at least one inner chain, the side chains and the at least one cross chain have a sufficient length to have contact with the bottom of the bucket, and to lie untensioned in the bottom of the bucket when the bucket is in the upright position. The grid has direct, continuous and uninterrupted contact with the bottom of the bucket when the bucket is in the empty and upright position.

Figure 3:
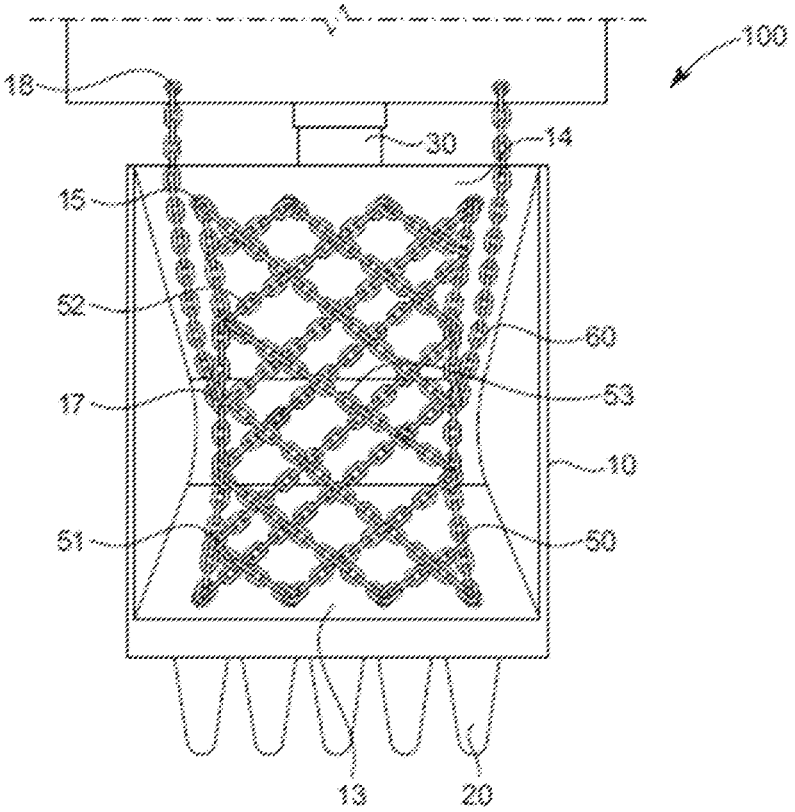
FIG. 3 is a top view of a second embodiment of the present invention in the empty and upright position.
Figure 5:
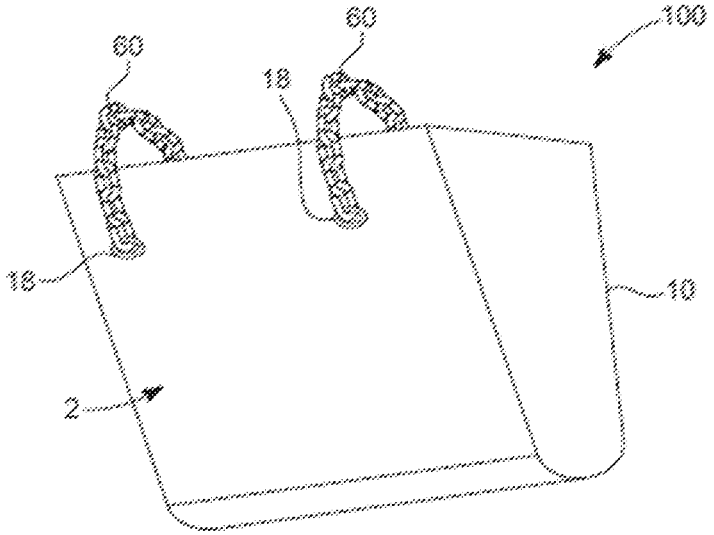
FIG. 5 is a side perspective view of an embodiment of the present invention in the upright position.

As further shown in FIGS. 1, 3 and 5, optionally, the excavation bucket with a chain adherent release device also includes at least one pull chain 60 having one end attached to the side chain at the pull chain attachment point 17 between the front attachment point and the back attachment point, and the second end attached outside the bucket at the pull chain outside attachment point 18. Optionally, rather than attached to the side chain, the pull chain can be attached to the cross chain or the inner chain between the front of the bucket and the back of the bucket, which is particularly effective on larger buckets. Optionally, rather than being attached to the pull chain outside attachment point 18, the pull chain can be attached to the arm 30. The pull chain can be releasably attached outside the bucket. The pull chain has sufficient length to allow the side chains to lie untensioned in the bottom of the bucket when the bucket is in the upright position, and is proximate the sides of the bucket. Preferably, there are two pull chains.

Figure 9:
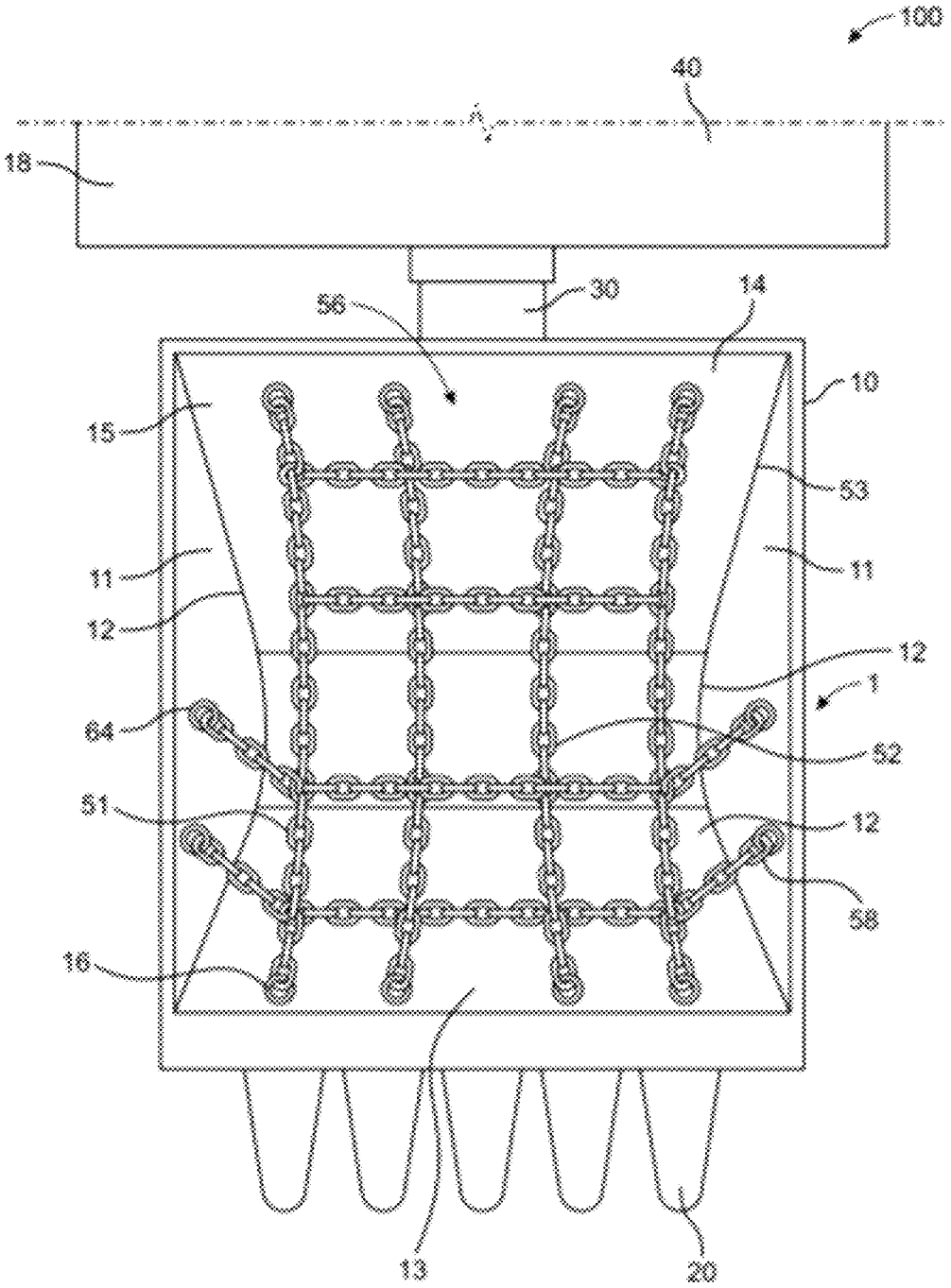
FIG. 9 is a top view of a preferred embodiment of the present invention in the empty and upright position.

As shown in FIG. 9, the bucket has at least two side wall chains 58 having a first end and a second end. The side wall chains are attached to the side chains 51 at the first end and to the side wall attachment points 64 at the second end. In a preferred embodiment, the side wall chains are attached to the side chains proximate the front of the bucket. This position prevents the debris being scooped up by the front of the bucket from depositing under the grid and not being released when the bucket is emptied. In this preferred embodiment, the at least one pull chain is not used, as the side wall chains work to release the debris when the bucket is emptied, and the pull chains are not needed.

The chain grid 56 is made of metal chains. Each of the side chains, inner chain, cross chain and pull chain can be of the same chain material or each of different chain materials. It is important that the chain material be metallic and heavy enough to fall downward when the bucket is inverted to be emptied and pull the adhering material out of the bottom of the bucket. It is also important that the chain material be robust and able to withstand unfavorable conditions, including wet, highly abrasive, rocky and crushing conditions.

Typical chains suitable for the present invention include but are not limited to Grades 30,43,70,80,100, and 120. The size of the links are sufficiently large to catch and pull out rocks and gravel, but not too small to get plugged up with debris. Preferably, the links are in the range of about ⅛ inch to 1 inch. More preferably, the links are from about ¼ to ¾ inch. More preferably, the links are ⅜ to ½ inch.

Figure 4:
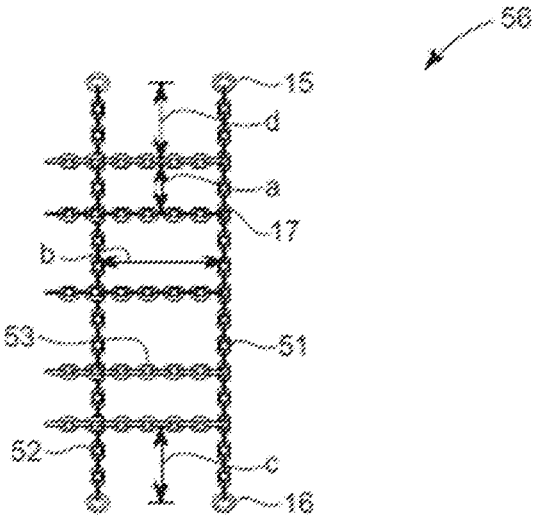
FIG. 4 is portion of the chain grid.

As shown in FIG. 4, the chain grid 56 made of the side chains, the at least one inner chain, and the at least one cross chain can have preferred dimensions. The dimensions will vary depending on the size of the bucket. A smaller bucket may have a smaller grid, while a larger bucket may have a larger grid. In a preferred embodiment, the distance "b" between the side chain and the inner chain can be in the range of from about two to six inches. More preferably, the range is from about three to five inches. Most preferably, the range is from about four to five inches. The distance between cross chains "a" is in the range of from about two to six inches. More preferably, the range is from about three to five inches. Most preferably, the range is from about four to five inches. Optionally the distance "a" is equal to the distance "b". The distance "d" from the cross chain to the back attachment point is in the range of about five to twelve inches. Preferably the distance is from about seven to ten inches. More preferably, the distance is from about eight to nine inches. The distance "c" from the cross chain to the front attachment point is in the range of about five to twelve inches. Preferably the distance is from about seven to ten inches. More preferably, the distance is from about eight to nine inches. Optionally the distance "c" is equal to the distance "d".

Preferably, there are from one to ten inner chains. More preferably there are two to five inner chains. The optimum number of inner chains depends on the size of the bucket, with larger buckets having more inner chains. Preferably, there are from two to ten cross chains. More preferably there are two to five cross chains. The optimum number of inner chains depends on the size of the bucket, with larger buckets having more inner chains.

As shown in FIGS. 1 and 3, the chain grids can have different configurations, such as parallel to the bucket sides or diagonal to the bucket sides. Other configurations are also contemplated in this invention. A number of configurations were tried and found to be ineffective in removing adherents. An "X" pattern of chains in the bucket failed to remove all the adherents from bucket. Four chains in parallel (without cross chains) in the bucket, loosely welded to the bottom of the bucket was ineffective in removing adherents. A cross "+" pattern with a pull chain attached to the center of the "+" and the arm had better results but was not consistent in removing adherents. A smaller grid similar to crosslink fencing was ineffective, as it plugged with gravel. It is only with the combination of side chains, at least one inner chain, at least one cross chain that adherents were effectively removed. In a preferred embodiment, the chain grid includes two pull chains attached to the side chains the cross chains or the inner chains between the front of the bucket and the back of the bucket.

Figure 6:
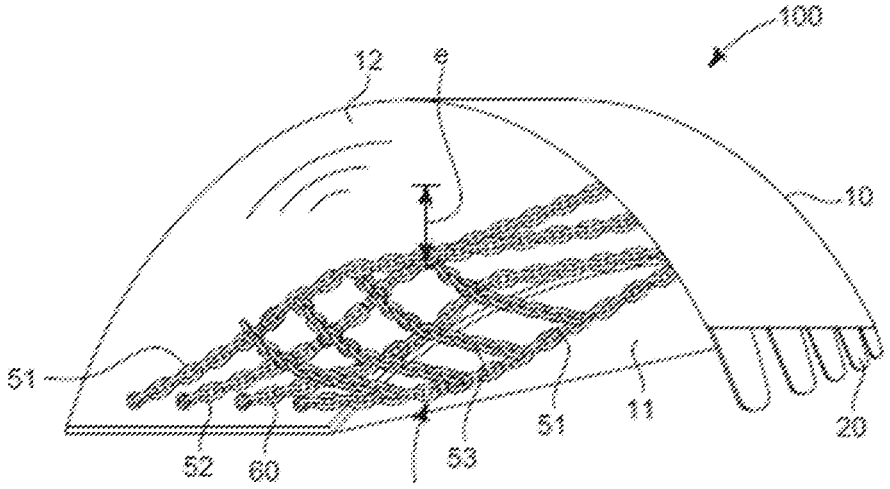
FIG. 6 is a cutaway side view of an embodiment of the present invention when the bucket is in the inverted position.

As shown in FIG. 6, when the bucket is inverted to empty the adherent, the chain grid falls away from the bottom of the bucket, creating a distance "e" from the bottom to the chain grid. In a preferred embodiment, the chain grid is attached to the bucket only at chain attachment to the bucket back 15 and front 16, and not elsewhere. This allows the grid 56 to move and fall forward when the bucket is inverted. This effectively removes the adherent and empties the bucket. The distance e is greater than about one inch. Preferably, the distance is from one to twelve inches. The larger the bucket, the greater the distance. For example, for large-scale mining equipment, the bucket can hold a ton of earth and debris, and the distance could be in multiple feet.

The chain attachment points to the front and the back of the bucket can be releaseable attachments or fixed attachments. Releaseable attachments include carabiners and other types of robust clips. Preferably fixed attachments include welding. Each side chain and inner chain is attached at both the front and back attachment points. Particularly at the front attachment points, each side chain and inner chain must be attached or large debris will wedge under the grid and cause it to fail to remove adherents. It is important that debris be deposited on top of the grid when the bucket is used. This allows the chain grid to effectively remove adherents.

The side chains are fixedly attached to the at least one cross chains, preferably by welding or other forms of attachment. Optionally, the at least one inner chains are attached to the at least one cross chains by welding or other forms of attachment. The pull chains are attached to the side chains, the inner chains or the cross chainsby welding or other forms of attachment. The pull chains are also attached outside the bucket, preferably releasably using a carabiner or other robust form of clip.

Figure 7:
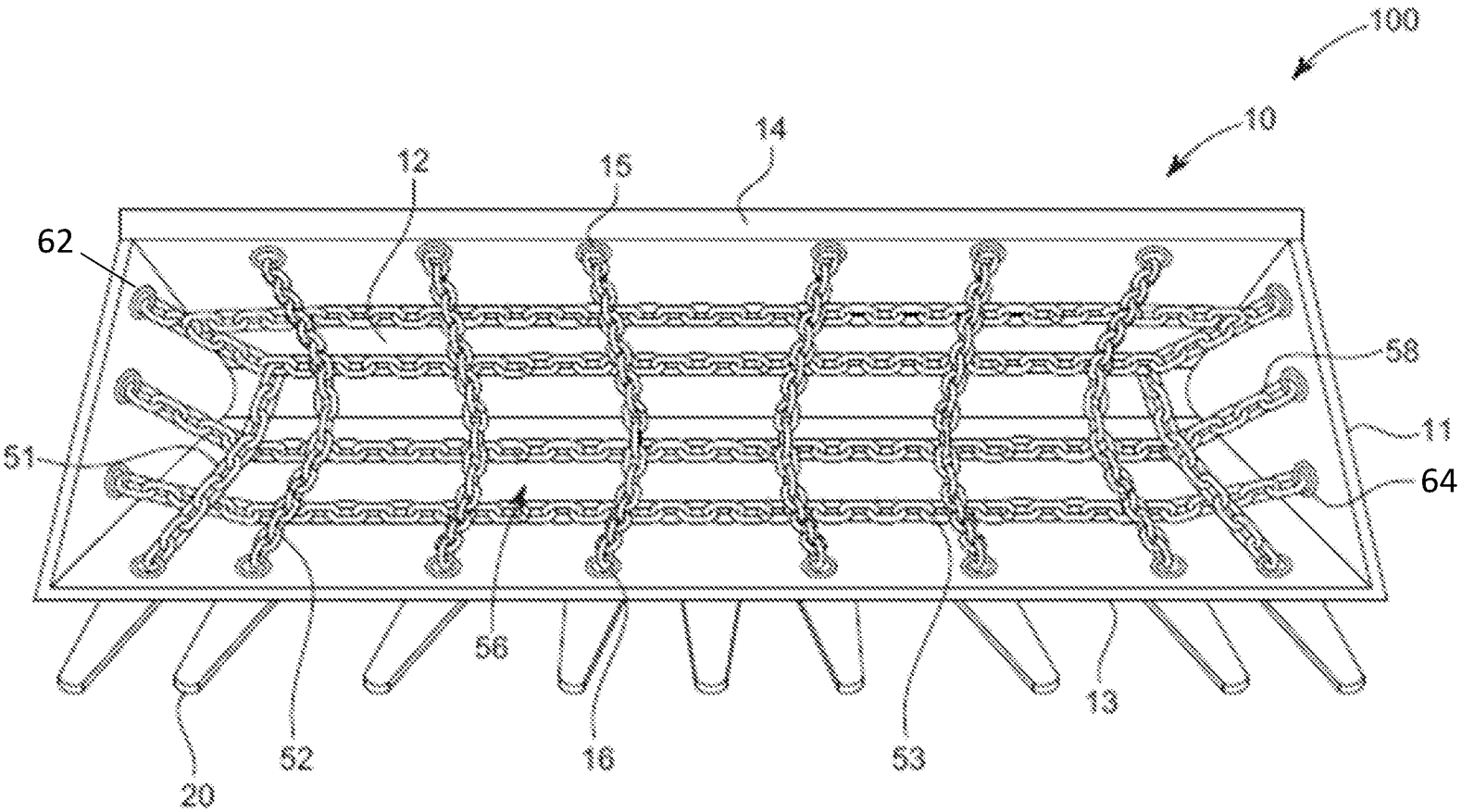
FIG. 7 is a front view of a third embodiment of the present invention in the forward and empty position.
Figure 8:
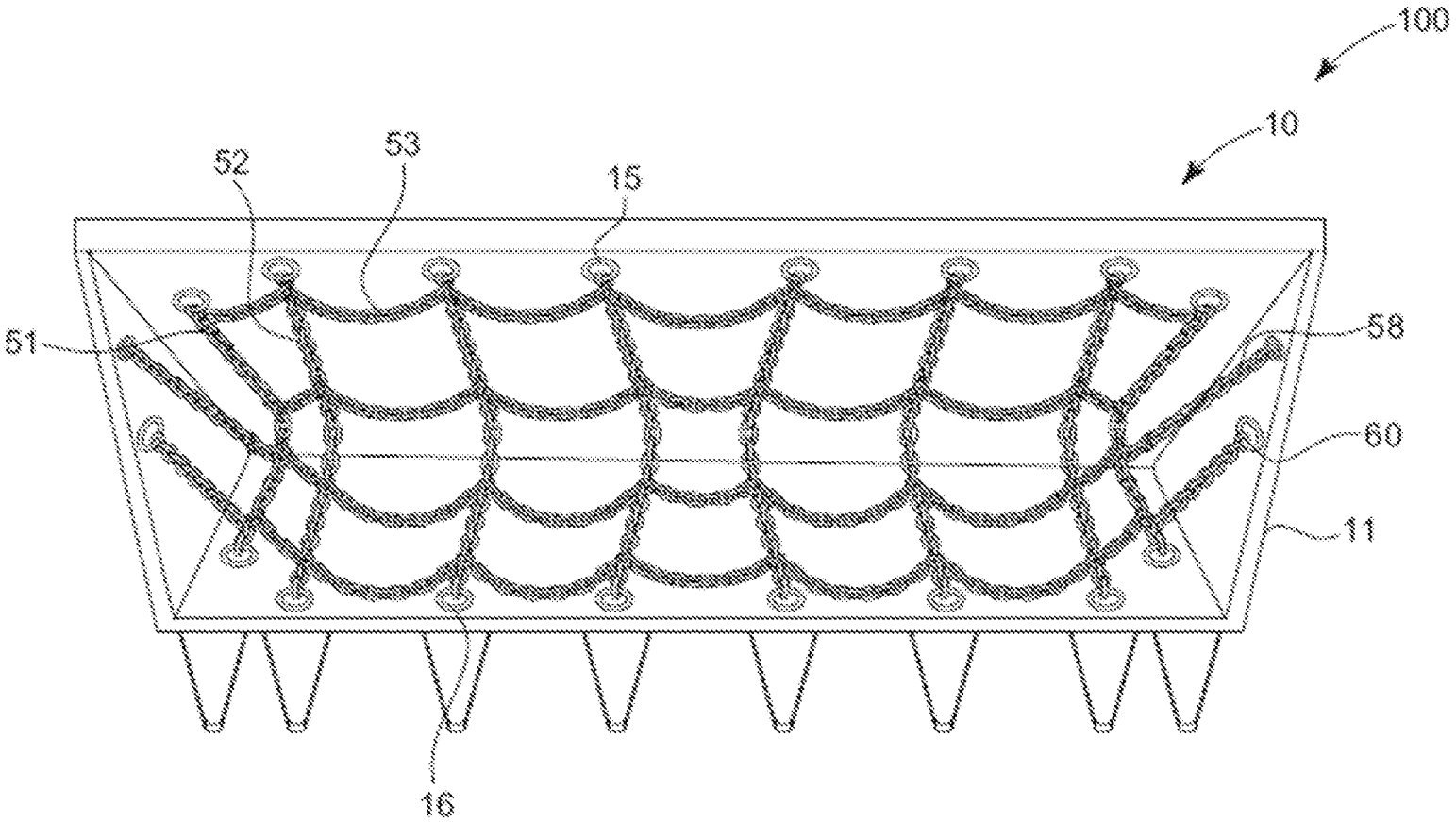
FIG. 8 is a front view of the third embodiment of the present invention in the 90 degree rotated down position.

FIGS. 7 and 8 show a preferred third embodiment of the invention, where a larger bucket is used for excavation. In FIG. 7, the bucket is empty and facing forward to move along the ground and dig. The chain grid 56 is resting on the bucket bottom 12. The bucket has attached to the sides 11 at least one side wall chain 58 having a first and a second sidewall chain end. The first at least one side wall chain 58 end is attached to the bucket walls at side wall attachment chain points 64. The at least one of the sidewall attachment point 64 is located on the sidewall between the proximate the inside back of the bucket 62 and proximate the inside front of the bucket. The second at least one side wall chain 58 end is attached to the side chain, or optionally the at least one cross chain 53. As shown in FIG. 7 in a preferred embodiment, the side chain 51 is attached to the side wall bucket attachment point proximate the inside back of the bucket 62. In a further preferred embodiment, the side chain 51 is attached to the side wall chains, and not attached to the chain attachment to the back point 15. The side wall chains are sufficiently long to allow the chain grid to lie untensioned in the bottom of the bucket. The chain grid has direct, continuous and uninterrupted contact with the bottom of the bucket when the bucket is in the empty and forward position. In a preferred embodiment, there are from about one to ten side wall chains. In a more preferred embodiment, there are from about two to five side wall chains.

In FIG. 8, the bucket is rotated about 90 degrees from the forward position to the down position to empty the bucket. In this configuration, the chain grid 56 has fallen forward to remove adherents from the bucket bottom. The bucket is not fully inverted yet empties with the rotation. The rotation can be from about 45 degrees to greater than 45 degrees, and to about 90 degrees or more.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. An excavation bucket with a chain grid adherent release device comprising:

a bucket;

wherein the bucket has a bottom and two sides, an inside configured to hold materials, an outside, a front, and a back;

wherein attached inside the bucket is a chain grid;

wherein the chain grid has two side chains positioned proximate the bucket sides, at least one inner chain spaced between the side chains, and at least one cross chain attached to the side chains and positioned between the front and back of the bucket, and at least one side wall chain having a first end and a second end;

wherein the side chains, the at least one inner chain and the at least one cross chain form the chain grid;

wherein the side chains and the at least one inner chain each have a first and a second end;

wherein for each of the side chains, the first end is attached to either a back bucket attachment point proximate the inside back of the bucket or at least one side wall bucket attachment point proximate the inside back of the bucket and the second end is attached to a front bucket attachment point proximate the inside front of the bucket;

wherein, for each of the at least one inner chain, the first end is attached to a back bucket attachment point proximate the inside back of the bucket and the second end is attached to a front bucket attachment point proximate the inside front of the bucket;

wherein the back bucket attachment points proximate the inside back of the bucket or the at least one side wall bucket attachment points proximate the inside back of the bucket, and the front bucket attachment points proximate the inside front of the bucket are the only bucket attachments for the side chains, the at least one cross chain and the at least one inner chain, allowing the chain grid to move away from the bottom of the bucket;

wherein the back bucket attachment points proximate the inside back of the bucket and the front bucket attachment points proximate the inside front of the bucket are spaced across the back of the bucket and the front of the bucket, respectively;

wherein the first end of each side wall chain is attached to the at least one sidewall attachment point; wherein the second end of each side wall chain is attached to the side chain; wherein the at least one side wall attachment point is the only bucket attachment for the at least one side wall chain and wherein when the bucket is in in the empty and upright position, the chain grid has direct, uninterrupted and continuous contact with the bottom of the bucket and lies untensioned in the bottom of the bucket.

2. The excavation bucket with a chain grid adherent release device of claim 1, wherein the first end of the side chain is attached to the at least one side wall bucket attachment point proximate the inside back of the bucket.

3. The excavation bucket with a chain grid adherent release device of claim 1, wherein the first end of the side chain is attached to a back bucket attachment point proximate the inside back of the bucket.

4. The excavation bucket with a chain grid adherent release device of claim 1 further comprising at least one pull chain having a first end attached to the side chain, the inner chain, or the cross chain between the inside front of the bucket and the inside back of the bucket, and a second end attached outside of the bucket; and wherein the at least one pull chain has sufficient length to allow the chain grid to lie untensioned in the bottom of the bucket when the bucket is in the empty, upright position.

5. The excavation bucket with a chain grid adherent release device of claim 1, wherein the at least one cross chain is attached to the at least one inner chain.

6. The excavation bucket with a chain grid adherent release device of claim 1, wherein there are at least two of the at least one side wall chains;

wherein the at least two side wall chains are attached to the bucket wall proximate the front of the bucket; and wherein there are no pull chains attached to the grid.

7. The excavation bucket with a chain grid adherent release device of claim 4 wherein the at least one pull chain comprises two pull chains, wherein the two pull chains each have a first end attached to the side chain.

8. An excavation bucket with a chain grid adherent release device comprising:

a bucket;

wherein the bucket has a bottom and two sides, an inside configured to hold materials, an outside, a front, and a back;

wherein attached inside the bucket is a chain grid;

wherein the chain grid has two side chains positioned proximate the bucket sides, at least one inner chain spaced between the side chains, at least one cross chain attached to the side chains and positioned between the front and back of the bucket, at least one side wall chain having a first end and a second end, and at least one pull chain attached to the side chains, the cross chains or the inner chains;

wherein the at least one cross chain is attached to the at least one inner chain;

wherein the side chains and the at least one inner chain each have a first and a second end;

wherein for each of the side chains, the first end is attached to either a back bucket attachment point proximate the inside back of the bucket or an at least one side wall bucket attachment point proximate the inside back of the bucket and the second end is attached to a front bucket attachment point proximate the inside front of the bucket;

wherein, for each of the at least one inner chain, the first end is attached to a back bucket attachment point proximate the inside back of the bucket and the second end is attached to a front bucket attachment point proximate the inside front of the bucket;

wherein the back bucket attachment points proximate the inside back of the bucket or the at least one side wall bucket attachment points proximate the inside back of the bucket, and the front bucket attachment points proximate the inside front of the bucket are the only bucket attachments for the side chains, the at least one cross chain and the at least one inner chain, allowing the chain grid to move away from the bottom of the bucket;

wherein the back bucket attachment points proximate the inside back of the bucket and the front bucket attachment points proximate the inside front of the bucket are spaced across the back of the bucket and the front of the bucket, respectively;

wherein the first end of each side wall chain is attached to the at least one sidewall attachment point; wherein the second end of each side wall chain is attached to the side chain; wherein the at least one side wall attachment point is the only bucket attachment for the at least one side wall chain wherein when the bucket is in in the empty and upright position, the chain grid has direct, uninterrupted and continuous contact with the bottom of the bucket and lies untensioned in the bottom of the bucket;

wherein the at least one pull chain has a first end attached to the side chain, inner chain or cross chain between the inside front of the bucket and the inside back of the bucket, and a second end attached outside of the bucket; and wherein the at least one pull chain has sufficient length to allow the chain grid to lie untensioned in the bottom of the bucket when the bucket is in the upright position.

9. The excavation bucket with a chain grid adherent release device of claim 8, wherein the first end of the side chain is attached to the at least one side wall bucket attachment point proximate the inside back of the bucket.

10. The excavation bucket with a chain grid adherent release device of claim 8, wherein the first end of the side chain is attached to a back bucket attachment point proximate the inside back of the bucket.

11. The excavation bucket with a chain grid adherent release device of claim 8, wherein there are at least two of the at least one side wall chains; and wherein the at least two side wall chains are attached to the bucket wall proximate the front of the bucket.

12. The excavation bucket with a chain grid adherent release device of claim 8 wherein the at least one pull chain comprises two pull chains, wherein the two pull chains each have a first end attached to the side chain.

13. An excavation bucket with a chain grid adherent release device comprising:

a bucket;

wherein the bucket has a bottom and two sides, an inside configured to hold materials, an outside, a front, and a back;

wherein attached inside the bucket is a chain grid;

wherein the chain grid has two side chains positioned proximate the bucket sides, at least one inner chain spaced between the side chains, and at least one cross chain attached to the side chains and positioned between the front and back of the bucket, and at least one side wall chain attached to the side chains;

wherein the at least one cross chain is attached to the at least one inner chain;

wherein the side chains and the at least one inner chain each have a first and a second end;

wherein for each of the side chains, the first end is attached to either a back bucket attachment point proximate the inside back of the bucket or at least one side wall bucket attachment point proximate the inside back of the bucket and the second end is attached to a front bucket attachment point proximate the inside front of the bucket;

wherein, for each of the at least one inner chain, the first end is attached to a back bucket attachment point proximate the inside back of the bucket and the second end is attached to a front bucket attachment point proximate the inside front of the bucket;

wherein the back bucket attachment points proximate the inside back of the bucket and the front bucket attachment points proximate the inside front of the bucket are spaced across the back of the bucket and the front of the bucket, respectively;

wherein the at least one side wall chain has a first and a second end;

wherein the first side wall chain end is attached to the at least one sidewall attachment point;

wherein the second side wall chain end is attached to the side chain;

wherein the back bucket attachment points proximate the inside back of the bucket, the at least one side wall bucket attachment points proximate the inside back of the bucket, the front bucket attachment points proximate the inside front of the bucket, and the at least one sidewall attachment points are the only bucket attachments for the side chains, the at least one cross chain, the at least one inner chain, the at least one side wall chains thereby allowing the chain grid to move away from the bottom of the bucket; and wherein when the bucket is in in the empty and upright position, the chain grid has direct, uninterrupted and continuous contact with the bottom of the bucket and lies untensioned in the bottom of the bucket.

14. The excavation bucket with a chain grid adherent release device of claim 13, wherein the first end of the side chain is attached to the at least one side wall bucket attachment point proximate the inside back of the bucket.

15. The excavation bucket with a chain grid adherent release device of claim 13, wherein the first end of the side chain is attached to a back bucket attachment point proximate the inside back of the bucket.

16. The excavation bucket with a chain grid adherent release device of claim 13, further comprising at least one pull chain having a first end attached to the side chain, the inner chain or the cross chain between the inside front of the bucket and the inside back of the bucket, and a second end attached outside of the bucket; and wherein the at least one pull chain has sufficient length to allow the chain grid to lie untensioned in the bottom of the bucket when the bucket is in the empty, upright position.

17. The excavation bucket with a chain grid adherent release device of claim 1, wherein there are at least two of the at least one side wall chains; and wherein the at least two of the at least one side wall chains are attached to the bucket wall proximate the front of the bucket.

18. The excavation bucket with a chain grid adherent release device of claim 13, wherein there are at least two of the at least one side wall chains;

wherein the at least two side wall chains are attached to the bucket wall proximate the front of the bucket; and wherein there are no pull chains attached to the grid.

* * * * *